US008926449B2

(12) United States Patent
Sato

(10) Patent No.: US 8,926,449 B2
(45) Date of Patent: Jan. 6, 2015

(54) GOLF CLUB HEAD

(71) Applicant: Bridgestone Sports Co., Ltd., Minato-ku, Tokyo (JP)

(72) Inventor: Fumiaki Sato, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 9 days.

(21) Appl. No.: 13/795,846

(22) Filed: Mar. 12, 2013

(65) Prior Publication Data

US 2013/0303304 A1 Nov. 14, 2013

(30) Foreign Application Priority Data

May 10, 2012 (JP) ..... 2012-108636

(51) Int. Cl.
*A63B 53/08* (2006.01)
*A63B 53/06* (2006.01)
*A63B 53/04* (2006.01)

(52) U.S. Cl.
CPC ..... *A63B 53/06* (2013.01); *A63B 53/0466* (2013.01); *A63B 2053/0433* (2013.01); *A63B 2053/0491* (2013.01)
USPC ..... 473/335; 473/334; 473/336; 473/338; 473/339

(58) Field of Classification Search
CPC ..... A63B 2053/0491; A63B 2053/0433; A63B 53/08
USPC ..... 473/336, 338, 339, 335, 337, 334
See application file for complete search history.

(56) References Cited

U.S. PATENT DOCUMENTS

| | | | | |
|---|---|---|---|---|
| 2,198,981 | A * | 4/1940 | Sullivan | 473/338 |
| 2008/0015049 | A1 * | 1/2008 | Imamoto | 473/338 |
| 2009/0298612 | A1 * | 12/2009 | Knutson et al. | 473/338 |

FOREIGN PATENT DOCUMENTS

JP 2010-69106 A 4/2010

* cited by examiner

*Primary Examiner* — Benjamin Layno
(74) *Attorney, Agent, or Firm* — Sughrue Mion, PLLC

(57) ABSTRACT

According to an aspect of this invention, a golf club head includes: a head main body; and a weight material detachably mounted in a weight material mounting portion in the head main body, an external screw thread on the weight material meshing with an internal screw thread in the weight material mounting portion, wherein: the weight material comprises a head portion having the external screw thread and a rod portion which projects from the head portion; and the internal screw thread is provided on an entrance side and a cylindrical portion is provided on a deeper side for engagement with the rod portion in the weight material mounting portion.

7 Claims, 12 Drawing Sheets

GOLF CLUB HEAD

BACKGROUND

1. Field of the Invention

The present invention relates to a golf club head and more particularly to a golf club head which includes a weight material.

2. Description of the Related Art

A golf club has a head which is attached to a distal end portion of a shaft. A grip is attached to a proximal end of the shaft.

In a general golf club head, a hosel hole is provided directly in the head, and a shaft is inserted into the hosel hole to be secured therein by an adhesive.

A golf club head is used in which a weight material is detachably mounted in the golf club head by being screwed thereinto to adjust the weight or balance of the golf club head (for example, JP-A-2010-69106).

FIG. 10 is a sectional view of a golf club head of JP-A-2010-69106. In this golf club head, an internally screw threaded hole 3 is provided in a sole portion of a head main body 2, and a weight material (a deadweight member) 4 is detachably mounted in the internally screw threaded hole 3 by being screwed thereinto.

When the weight material 4 is screwed into the internally screw threaded hole 3 in the way described above, the weight material 4 is placed at the entrance of the internally screw threaded hole 3 and a tool is brought into engagement with the weight material 4 to screw the weight material 4 into the internally screw threaded hole 3. As this occurs, in placing the weight material 4 at the entrance of the internally screw threaded hole 3, the weight material 4 needs to be placed thereat properly concentrically with much care before it is turned by the tool. Should the axial direction of the weight material 4 intersects obliquely the axial direction of the internally screw threaded hole 3, even when the weight material 4 is turned, the weight material 4 is not screwed into the internally screw threaded hole 3, or the weight material 4 is forced to be screwed into the internally screw threaded hole 3 with the weight material 4 kept inclined, resulting in fears that the screw threaded surface of the internally screw threaded hole 3 is damaged.

Additionally, in the conventional example shown in FIG. 10, when the weight material 4 is placed at the entrance of the internally screw threaded hole 3 or is turned, the weight material 4 tends to come off easily from the internally screw threaded hole 3. Due to these facts, with the conventional golf club head, it takes some labor hours to mount the weight material.

SUMMARY

An object of the invention is to provide a golf club head which enables an easy mounting of a weight material in an internally screw threaded hole.

According to the invention, there is provided a golf club head including: a head main body; and a weight material detachably mounted in a weight material mounting portion in the head main body, an external screw thread on the weight material meshing with an internal screw thread in the weight material mounting portion, wherein: the weight material comprises a head portion having the external screw thread and a rod portion which projects from the head portion; and the internal screw thread is provided on an entrance side and a cylindrical portion is provided on a deeper side for engagement with the rod portion in the weight material mounting portion.

The rod portion may be rotatable relative to the head portion.

A part having a different specific weight may be detachably attached to the weight material.

The weight material may be mounted in a sole portion of the golf club head in an inclined direction.

In the golf club head of the invention, in mounting the weight material in the weight material mounting portion, the rod portion of the weight material is brought into engagement with the cylindrical portion of the weight material mounting portion. By doing so, not only can the weight material be prevented from coming off from the weight material mounting portion, but also the weight material can be positioned concentrically with the weight material mounting portion, whereby the weight material can easily be screwed into the weight material mounting portion.

When the rod portion is made rotatable relative to the head portion, it is possible to screw the weight material into the weight material mounting portion by turning only the head portion.

The weight of the weight material can be adjusted by attaching the part having the different specific weight to the weight material.

BRIEF DESCRIPTION OF THE DRAWINGS

The present invention will become more fully understood from the detailed description given hereinbelow and the accompanying drawing which is given byway of illustration only, and thus is not limitative of the present invention and wherein.

DETAILED DESCRIPTION OF THE INVENTION

Hereinafter, embodiments of the invention will be described by reference to the drawings.

FIGS. 1 to 4B show a golf club head 5 according to a first embodiment. This golf club head 5 has a head main body 6, weight material mounting portions 7 which are provided in a sole portion and a back portion of the head main body 6, and a weight material 10 adapted to be detachably mounted in any of the weight material mounting portions 7 by being screwed thereinto.

Figure 4A:
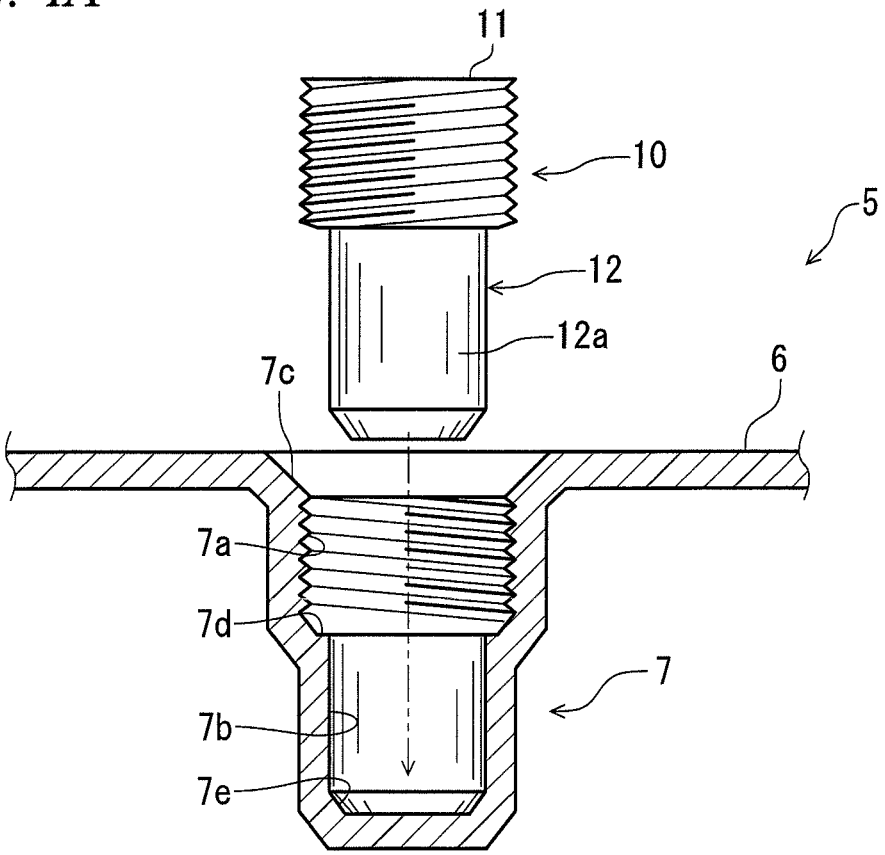
FIGS. 4A and 4B are diagrams showing a state in which a weight material is being mounted into the weight material mounting portion shown in FIG. 1.
Figure 4B:
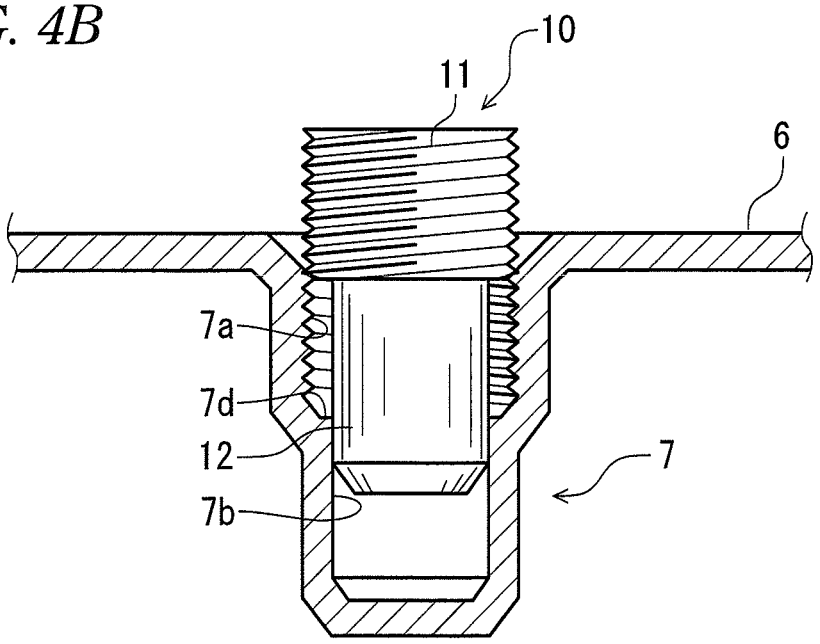

As shown in FIGS. 4A and 4B, the weight material mounting portion 7 has an internally screw threaded portion 7*a* which is provided on an entrance side and a cylindrical portion 7*b* having no internal screw thread which is provided on a deep side thereof. In this embodiment, a circumferential edge portion of an entrance of the weight material mounting portion 7 is chamfered to thereby form a chamfered or tapered surface 7*c* thereat. A bore diameter of the tube portion 7*b* is smaller than a bore diameter of the internally screw threaded portion 7*a*, and a step portion 7*d* is formed at a boundary portion between the internally screw threaded portion 7*a* and the cylindrical portion 7*b*. In this embodiment, the cylindrical portion 7*b* has a circular cylindrical shape. A corner portion at a deepest portion of the cylindrical portion 7*b* is formed into a tapered surface 7*e*.

Figure 2:
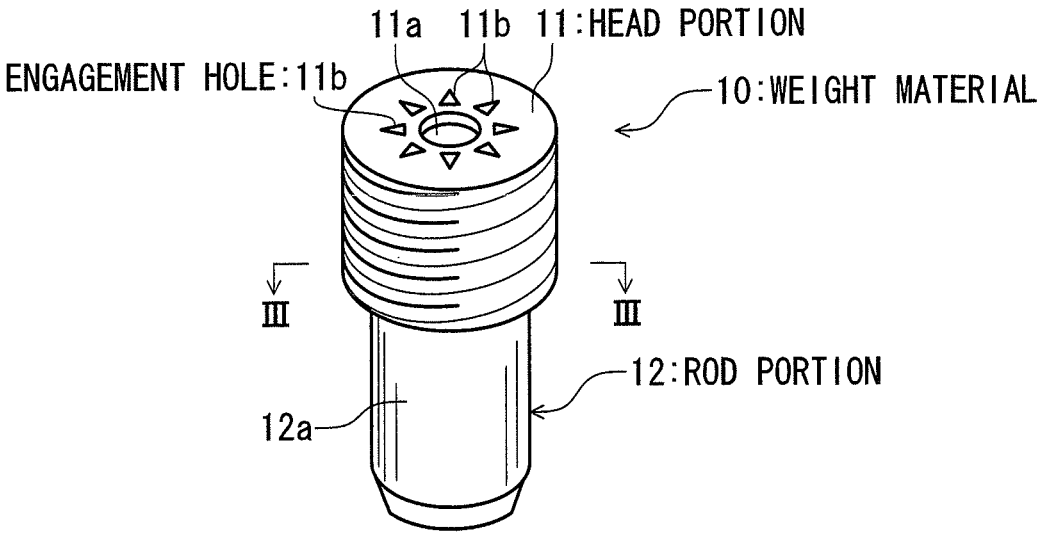
FIG. 2 is a perspective view of a weight material in FIG. 1.
Figure 3:
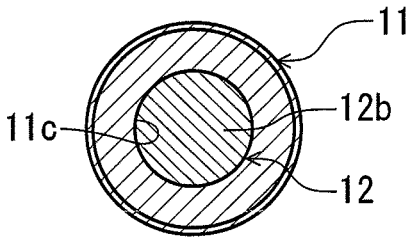
FIG. 3 is a sectional view taken along the line in FIG. 2.

As shown in FIG. 2, the weight member 10 has a head portion 11 on an outer circumferential surface of which an external screw thread is provided, and a rod portion 12 which is secured to the head portion 11. Tool engagement holes 11*a*, 11*b* are provided in a top end surface of the head portion 11.

Figure 1:
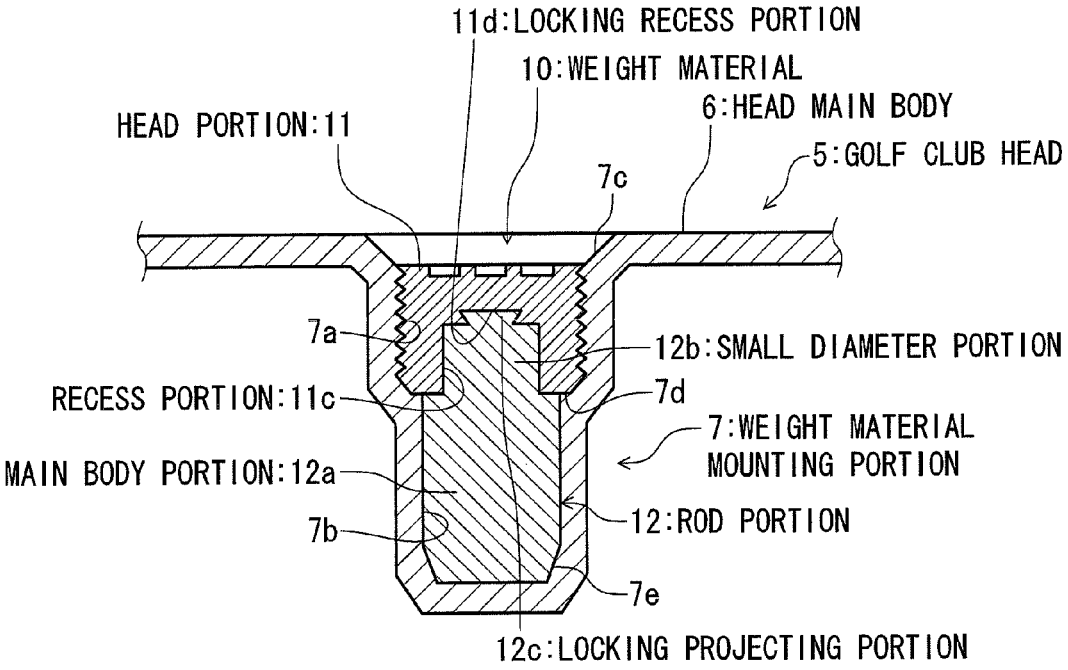
FIG. 1 is a sectional view of a weight material mounting portion according to an embodiment of the invention.

As shown in FIG. 1, an opposite surface of the head portion 11 to the top end surface is formed into a recess portion 11*c*, and the rod portion 12 is inserted into this recess portion 11*c*. A locking recess portion 11*d* is provided in a deep bottom surface of the recess portion 11*c*, and an entrance side of this locking recess portion 11*d* is smaller in diameter than a deep side thereof.

The rod portion 12 has a main body portion 12*a* which projects from the head portion 11, a small diameter portion 12*b* that is smaller in diameter than the main body portion 12*a* and which is inserted into the recess portion 11*c*, and a locking projecting portion 12*c* which projects from a distal end face of the small diameter portion 12*b*. This locking projecting portion 12*c* is smaller in diameter at a proximal end than at a distal end thereof and has the same shape and size as those of the locking recess portion 11*d*. This locking projecting portion 12*c* is fitted in the locking recess portion 11*d* through cooling fit, shrink-fit or forced fit, whereby the head portion 11 and the rod portion 12 are integrated into a single body.

The rod portion 12 is concentric with the head portion 11. In this embodiment, the rod portion 12 may be rotatable or prohibited to rotate relative to the head portion 11.

In mounting the weight material 10 in the weight material mounting portion 7, as shown in FIG. 4A, the weight material 10 is caused to approach the weight material mounting portion 7. Then, as shown in FIG. 4B, the rod portion 12 of the weight material 10 is inserted into the cylindrical portion 7*b* of the weight material mounting portion 7, whereafter a tool is brought into engagement with the tool engagement holes 11*a*, 11*b*, and the weight material 10 is turned by the tool.

The rod portion 12 is provided on the weight material 10, and the rod portion 12 is brought into engagement with the cylindrical portion 7*b* only by inserting the weight material 10 into the weight material mounting portion 7 as shown in FIG. 4B, whereby the weight material 10 is placed concentric with the weight material mounting portion 7 accurately. Due to this, when the weight material 10 is turned from the state shown in FIG. 4B, the external screw thread on the weight material 10 meshes smoothly with the internal screw thread in the inner circumferential surface of the internally screw threaded portion 7*a* of the weight material mounting portion 7. When the weight material 10 is turned to be screwed into the weight material mounting portion 7 sufficiently, a lower end face of the head portion 11 is pressed against the step portion 7*d* strongly, whereby the weight material 10 is mounted firmly in the weight material mounting portion 7.

Additionally, in this embodiment, as shown in FIG. 4B, the rod portion 12 is in engagement with the cylindrical portion 7*b* in such a state that the weight material 10 is inserted in the weight material mounting portion 7, and therefore, it becomes difficult that the weight material 10 comes off from the weight material mounting portion 7 while the mounting work is being performed.

In this way, according to the embodiment, the weight material 10 can be mounted in the weight material mounting portion 7 extremely easily.

Figure 5:
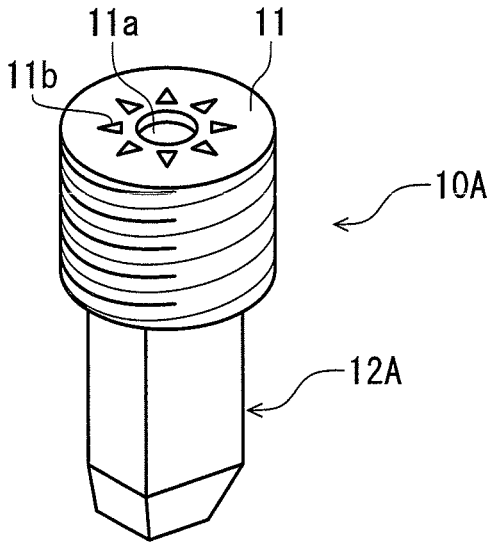
FIG. 5 is a perspective view showing another weight material.

In the embodiment, while the rod portion 12 has the cylindrical shape, as in a weight material 10A shown in FIG. 5, a rod portion 12A may have a prism-like shape. As this occurs, the rod portion 12A is left rotatable relative to a head portion 11. The other configurations of the weight material 10A shown in FIG. 5 are the same as those of the weight material 10, and like reference numerals denote like portions.

Figure 6A:
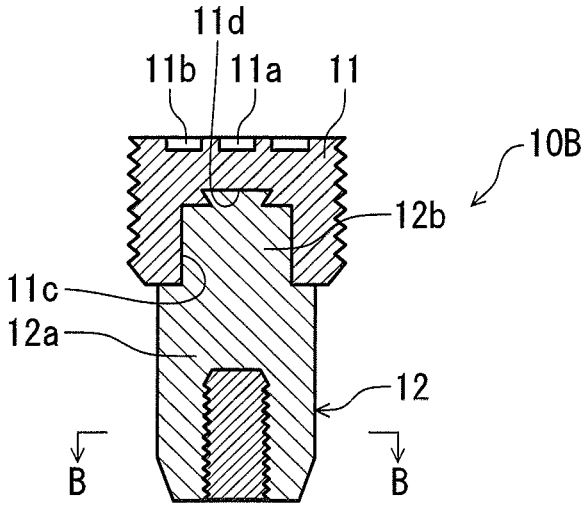
FIG. 6A is a sectional view of a further weight material.
Figure 6B:
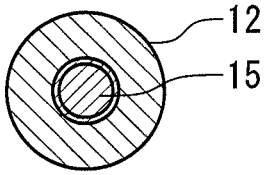
FIG. 6B is a sectional view taken along the line B-B in FIG. 6A.

In this invention, as in a weight material 10B shown in FIGS. 6A and 6B, a part 15 may be detachably attached to a rod portion 12 by being screwed thereinto. As this occurs, the weight of the weight material 10B can be changed by detaching the part 15 or replacing the part 15 with another part having a different weight. The other configurations of the weight material 10B are the same as those of the weight material 10, and the other reference numerals in FIGS. 6A and 6B are denoted like portions to those of the weight material 10.

Figure 7A:
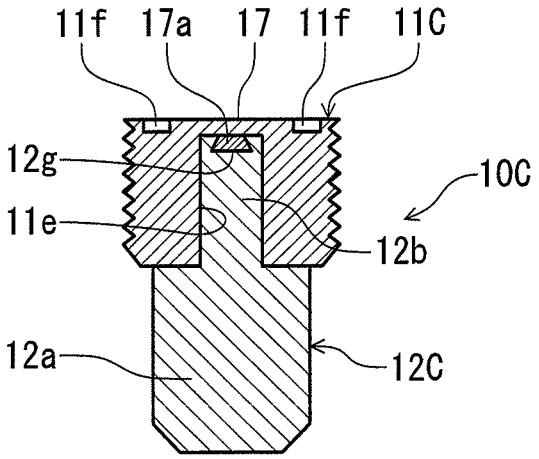
FIG. 7A is a sectional view of a further weight material.
Figure 7B:
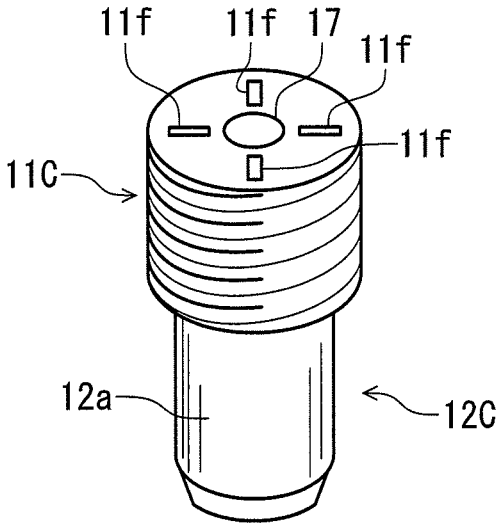
FIG. 7B is a perspective view of the weight material.

In a weight material 10C shown in FIGS. 7A and 7B, a through hole 11*e* is provided in a head portion 11C so as to penetrate an axial portion thereof. A small diameter portion 12*b* of a rod portion 12C is rotatably inserted into the through hole 11*e*. A stopper plate 17 is attached to a distal end face of the small diameter portion 12*b*. A locking projection 17*a* is provided on this stopper plate 17, and this locking projection 17*a* is larger in diameter at a distal end than at a proximal end. This locking projection 17*a* is fitted in a locking recess portion 12*g* having the same configuration which is provided in the distal end face of the small diameter portion 12*b*. The stopper plate 17 is a circular disk which is larger in diameter than the through hole 11*e*, and the rod portion 12*c* cannot be removed from the head portion 11C.

A main body portion 12*a* of the rod portion 12C is larger in diameter than the small diameter portion 12*b*. The small diameter portion 12*b* and the through hole 11*e* have a circular cross section which is normal to the direction of axes thereof, and the head portion 11C is rotatable relative to the rod portion 12C. The tool can be brought into engagement with tool engagement holes 11*f* in a top end face of the head portion 11C to turn the head portion 11C.

Figure 8:
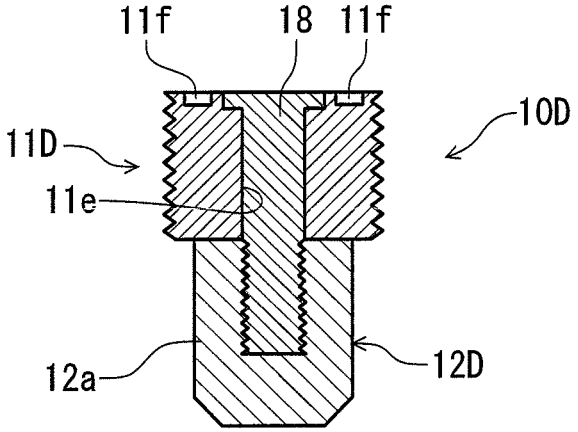
FIG. 8 is a sectional view of another weight material.

In a weight material 10D shown in FIG. 8, a rod portion 12D is fastened to a head portion 11D by a bolt 18 so that the head portion 11D and the rod portion 12D are integrated into a single body. The other configurations thereof are the same as those of the weight material 100, and like reference numerals denote like portions.

Figure 9:
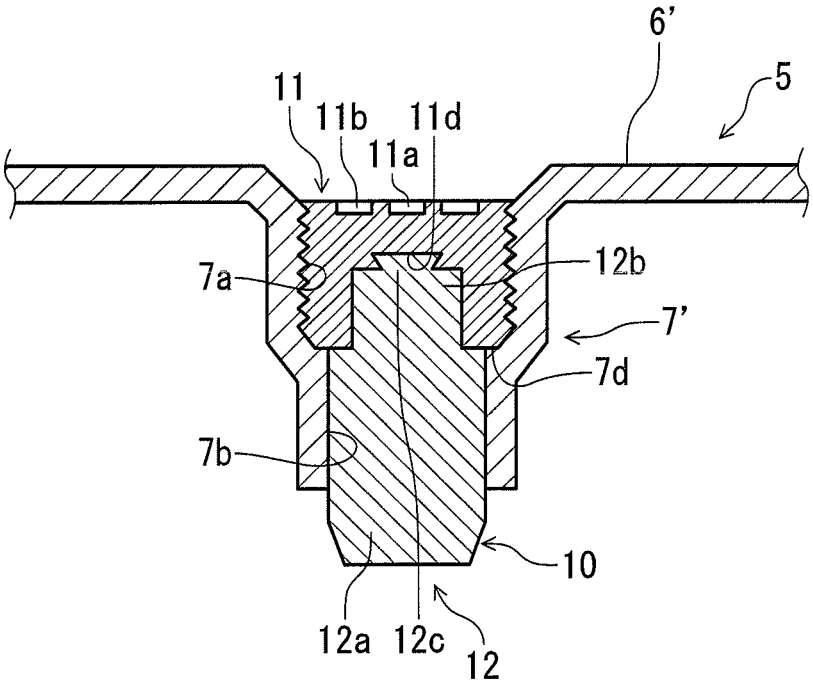
FIG. 9 is a sectional view of a weight material mounting portion of a golf club head according to another embodiment of the invention.
Figure 10:
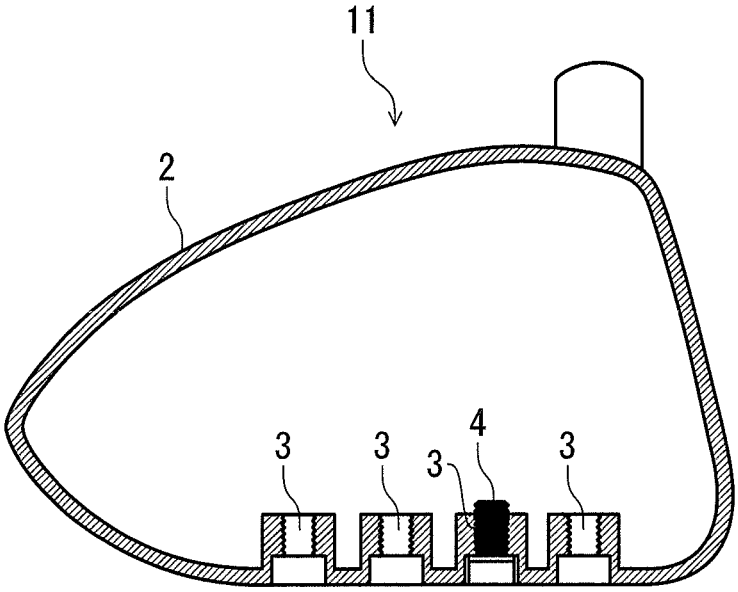
FIG. 10 is a sectional view of a conventional golf club head.

In the embodiments described above, while the weight material mounting portion 7 is not a through hole, as in a weight material mounting portion 7' in a head main body 6' shown in FIG. 9, the weight material mounting portion 7' may be a hollow cylinder having a through hole which penetrates therethrough. The other configurations shown in FIG. 9 are the same as those shown in FIG. 1, and like reference numerals denote like portions.

Figure 11:
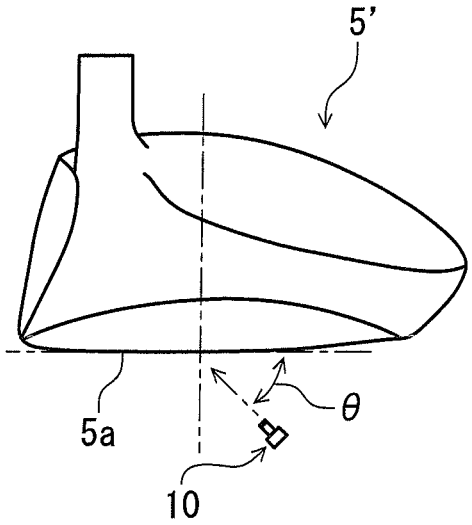
FIG. 11 is a side view of a golf club head according to a further embodiment of the invention.
Figure 12:
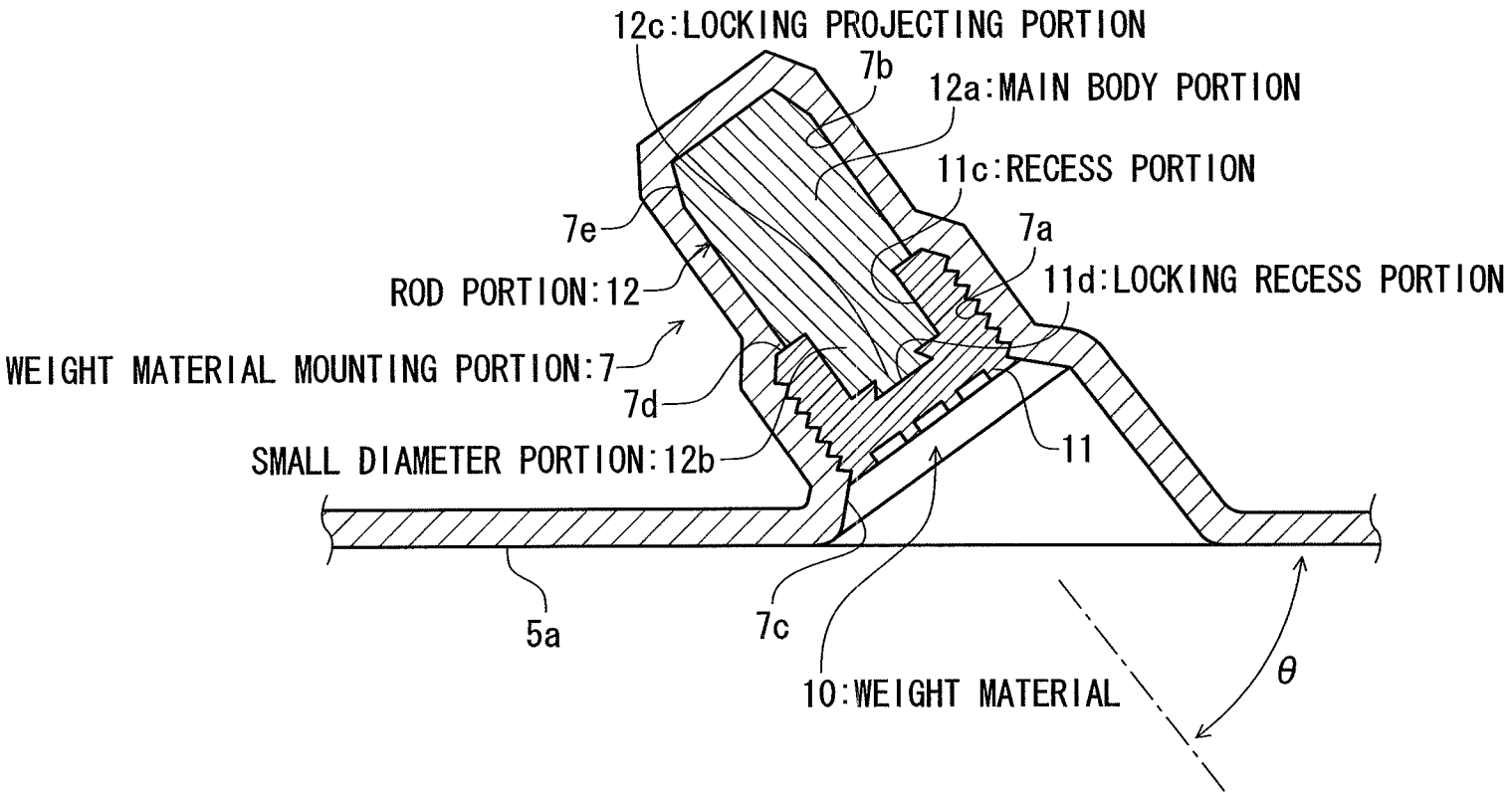
FIG. 12 is a sectional view of a weight material mounting portion in the golf club head shown in FIG. 11.

In this invention, the weight material may be mounted in the sole portion in an inclined fashion. FIG. 11 is a side view of a golf club head as seen from a heel side which shows an example of an inclined mounting of a weight material into a sole portion thereof, and FIG. 12 is a vertical sectional view of a weight material mounting portion in the golf club head 5' taken along a toe-to-heel direction of the head. As shown in the figures, a weight material mounting portion 7 is provided in a sole portion 5*a* of the golf club head 5' in such a manner that an axial direction thereof intersects a horizontal plane which constitutes a surface of the sole portion 5*a* obliquely at an angle of θ as seen in the toe-to-heel direction of the head. This angle θ is in the range of 10 to 60°, preferably in the range of 20 to 50° and more preferably in the range of 30 to 45°. As shown in FIGS. 11, 12, the weight material mounting portion 7 is inclined so that a deep side thereof moves further forwards towards a toe side of the golf club head 5' as it extends thereinto.

When a weight material 10 is mounted in the sole portion 5*a* in the inclined fashion in the way described above, compared with when the weight member 10 is mounted in the golf club head 5' normal to the surface of the sole portion 5*a*, it becomes difficult that the weight material 10 is loosened even when vibration generated at the time of impact is applied thereto.

When the construction of ribs within the golf club head or an inner construction of the sole thereof is changed to make it difficult for the weight material 10 to be loosened, it happens from time to time that the natural frequency of the golf club head is changed to thereby change the striking sound or that the amplitude of vibration generated when the golf club head hits a golf ball becomes small due to the ribs. However, when the weight material mounting portion and the weight material are inclined, the occurrence of these changes in striking sound and vibration amplitude are prevented. When the angle θ is larger than 60°, the working effect described above becomes poor, while when the angle θ is smaller than 10°, the construction of the weight material mounting portion becomes complex, and the weight thereof is increased, whereby the extent of weight adjustment by the weight material is reduced.

What is claimed is:

1. A golf club head comprising:

a head main body; and a weight material detachably mounted in a weight material mounting portion in the head main body, an external screw thread on the weight material meshing with an internal screw thread in the weight material mounting portion, wherein:

the weight material comprises a head portion having the external screw thread and a rod portion which projects from the head portion;

the internal screw thread is provided on an entrance side and a cylindrical portion is provided on a deeper side for engagement with the rod portion in the weight material mounting portion;

an opposite surface of the head portion that is opposite to the top end surface is formed into a recess portion, and a locking recess portion is provided in a deepest bottom surface of the recess portion;

the rod portion comprises a small diameter portion which is inserted into the recess portion; and a locking projecting portion which projects from a distal end face of the small diameter portion; and a circumferential edge portion of an entrance of the weight material mounting portion is chamfered to thereby form a chamfered or tapered surface at the edge portion.

2. The golf club head according to claim 1, wherein the rod portion is rotatable relative to the head portion.

3. The golf club head according to claim 1, wherein apart, having a different specific weight, is detachably attached to the weight material.

4. The golf club head according to claim 1, wherein the weight material is mounted in a sole portion of the golf club head in an inclined direction.

5. The golf club head according to claim 1, wherein:

an entrance side of the locking recess portion is smaller in diameter than a deep side thereof; and the locking projecting portion is smaller in diameter at a proximal end than at a distal end thereof.

6. The golf club head according to claim 1, wherein the weight material mounting portion is inclined with respect to a sole surface.

7. The golf club head according to claim 6, wherein an inclination angle of the weight material mounting portion is in the range of 10 to 60°.

* * * * *